US006941627B2

(12) United States Patent
Fritsche et al.

(10) Patent No.: US 6,941,627 B2
(45) Date of Patent: Sep. 13, 2005

(54) ADAPTABLE FASTENER INSTALLATION TOOL

(75) Inventors: David L. Fritsche, Foristell, MO (US); Daniel D. Bloch, St. Peters, MO (US)

(73) Assignee: The Boeing Company, Chicago, IL (US)

( * ) Notice: Subject to any disclaimer, the term of this patent is extended or adjusted under 35 U.S.C. 154(b) by 0 days.

(21) Appl. No.: 10/610,078

(22) Filed: Jun. 30, 2003

(65) Prior Publication Data

US 2004/0261260 A1 Dec. 30, 2004

(51) Int. Cl.[7] ..... B23P 11/00

(52) U.S. Cl. ..... 29/243.53; 29/809; 29/525.06; 227/139; 227/140

(58) Field of Search ..... 29/243.53, 34 B, 29/809, 524.1, 525.01, 525.05, 525.06, 509, 275; 227/139, 140

(56) References Cited

U.S. PATENT DOCUMENTS

| | | | | | |
|---|---|---|---|---|---|
| 2,901,749 | A | * | 9/1959 | Crossen et al. | 227/139 |
| 2,943,328 | A | * | 7/1960 | Carpenter et al. | 173/15 |
| 3,600,928 | A | * | 8/1971 | Retherford | 72/356 |
| 3,848,322 | A | * | 11/1974 | Kuehn et al. | 29/453 |
| 4,044,462 | A | * | 8/1977 | Anselmo | 29/809 |
| 4,113,049 | A | * | 9/1978 | Lieber | 181/230 |
| 4,463,889 | A | * | 8/1984 | Sartran | 227/112 |
| 4,747,294 | A | * | 5/1988 | Schwartz et al. | 29/812.5 |
| 4,776,408 | A | * | 10/1988 | Elkin et al. | 173/211 |
| 5,181,315 | A | * | 1/1993 | Goodsmith | 29/798 |
| 5,575,051 | A | * | 11/1996 | Moore | 29/243.523 |
| 5,588,554 | A | * | 12/1996 | Jones | 221/88 |
| 5,813,114 | A | * | 9/1998 | Blacket et al. | 29/809 |
| 5,964,393 | A | * | 10/1999 | Feldpausch et al. | 227/135 |
| 5,974,660 | A | * | 11/1999 | Muller | 29/823 |
| 6,357,101 | B1 | * | 3/2002 | Sarh et al. | 29/407.09 |
| 6,772,508 | B2 | * | 8/2004 | Bloch et al. | 29/709 |
| 6,796,020 | B2 | * | 9/2004 | Thompson | 29/712 |

FOREIGN PATENT DOCUMENTS

| | | | | | |
|---|---|---|---|---|---|
| GB | 2082104 | A | * | 3/1982 | B25B/27/14 |
| JP | 56077042 | A | * | 6/1981 | B21J/15/32 |

* cited by examiner

*Primary Examiner*—Essama Omgba
(74) *Attorney, Agent, or Firm*—Harness Dickey & Pierce P.L.C.

(57) ABSTRACT

A system for installing fasteners into a workpiece. The system includes a fastener orientation system and an installation unit. The fastener orientation system receives the fastener from a fastener delivery tube and retains the fastener in a holding jaw. Specifically, the fastener is retained by a plurality of deformable fingers in the holding jaw. The installation unit is coupled to the fastener orientation system and operable to move laterally with respect to the fastener orientation system to provide a force for securing the fastener in the workpiece.

26 Claims, 4 Drawing Sheets

ADAPTABLE FASTENER INSTALLATION TOOL

FIELD OF THE INVENTION

The present invention relates generally to mechanized fastening equipment and more particularly to equipment that receives and positions fasteners for installation into a workpiece.

BACKGROUND OF THE INVENTION

Manufacturing equipment that automatically delivers fasteners to a workpiece, or a fastening device, is typically employed in high rate production environments. The equipment generally comprises a storage device for the fasteners and a mechanism or system that transports fasteners from the storage device to the workpiece or fastening device. For example, U.S. Pat. No. 5,588,554 to Jones, the contents of which are incorporated herein by reference in their entirety, discloses a device for delivering fasteners to a workpiece comprising a suction head that removes fasteners from a storage area and delivers the fasteners through a delivery tube using a vacuum. The fasteners are individually stored in holes of a predetermined or fixed depth, and only one fastener may be stored in any given hole. Accordingly, each hole contains a fastener of a specific configuration, diameter, and grip length. Moreover, the device of Jones is incorporated in a relatively large assembly system that is permanently installed at a fixed location within a production facility.

In the production assembly of aircraft, the majority of substructure such as fuselage frames and longerons, along with wing spars and ribs, are joined to the skin of the aircraft with thousands of fasteners. Further, a plurality of fastener types, along with variations in diameters and grip lengths, are typically used in an aircraft assembly or subassembly. Generally, a fastener "grip length" refers to the cumulative thickness of the parts that the fastener holds together. Moreover, a majority of the substructure parts are manually assembled rather than by using automated fastening equipment.

During manual assembly operations, an operator must first determine the appropriate fastener type and diameter from a blueprint or other manufacturing work instruction delivery system. Due to manufacturing variations in individual part fabrication and assembly positioning variations, the proper grip length of the fastener is often determined by manually measuring hole depths. Once the proper fastener configuration is determined, the fastener stock must then be located and selected from fastener bins, which are typically stored at a common location near the work station. A limited number of fasteners are then moved by hand from the fastener bins to the work station and are generally staged within the reach of an operator. If permitted by the work environment, several fasteners are stored in a pouch that is secured around the waist of an operator. Accordingly, the operator sorts through the fasteners to select the proper configuration and inserts the fastener directly into a hole through the parts or inserts the fastener into an installation tool that installs the fastener through the parts.

As a result, a significant amount of time is spent by an operator determining the proper fastener configuration, locating the fastener within a storage bin, and transporting the fastener to the work station for installation. Thus making manual fastener installation very time consuming. Therefore, it is desirable to have a fastener system which portable and automated.

One portable device has been developed by the applicant in U.S. Patent Application titled "Portable Automatic Fastener Delivery System," Ser. No. 09/931,501 filed Aug. 16, 2001, the contents of which are incorporated herein by reference in their entirety. The portable device delivers a plurality of different fastener types and sizes on request to an operator, and the operator then manually orients the fastener properly and inserts the fastener into a workpiece for subsequent installation.

Accordingly, a need remains in the art for a device that catches fasteners from an automatic fastener delivery system and that properly orients the fasteners for installation into a workpiece. A further need exists for such a device that inserts the fasteners into the workpiece for subsequent installation.

SUMMARY OF THE INVENTION

The present invention is directed to a system for installing fasteners into a workpiece. The system includes a fastener orientation system and an installation unit. A fastener delivery tube provides the fastener orientation system with the fastener. The fastener orientation system further includes a holding jaw. The fastener is retained by plurality of fingers in the holding jaw. The installation unit is coupled to the fastener orientation system and operable to move laterally with respect to the fastener orientation system to provide a force for securing the fastener in the workpiece.

More specifically, the present invention provides a fastener installation system for use with an automated fastener delivery tube. The fastener delivery tube is coupled to a catcher block which is further coupled to a holding jaw. The holding jaw has a plurality of fingers for retaining a fastener therein. A telescopic yoke is also coupled to the catcher block and a pneumatic rivet gun. The pneumatic rivet gun includes a rivet set which is operable to engage the fastener and install the fastener into a workpiece. A damping bushing is coupled to the rivet gun and the telescopic yoke to limit the travel of the rivet gun during the installation of the fastener.

BRIEF DESCRIPTION OF THE DRAWINGS

The present invention will become more fully understood from the detailed description and the accompanying drawings, wherein:

FIG. 4 is a front view of the tool shown in FIG. 1;

DETAILED DESCRIPTION OF THE PREFERRED EMBODIMENTS

The following description of the preferred embodiment is merely exemplary in nature and is in no way intended to limit the invention, its application, or uses.

The present invention is generally related to a system for installing fasteners in a workpiece, in particular, an adaptable tool for the installation of fasteners. In this regard, the invention will be described in the context of an adaptable fastener installation tool for use with interference fit assemblies. However, it is to be understood that the principles embodied herein are equally applicable to other types of fastening methods.

Figure 1:
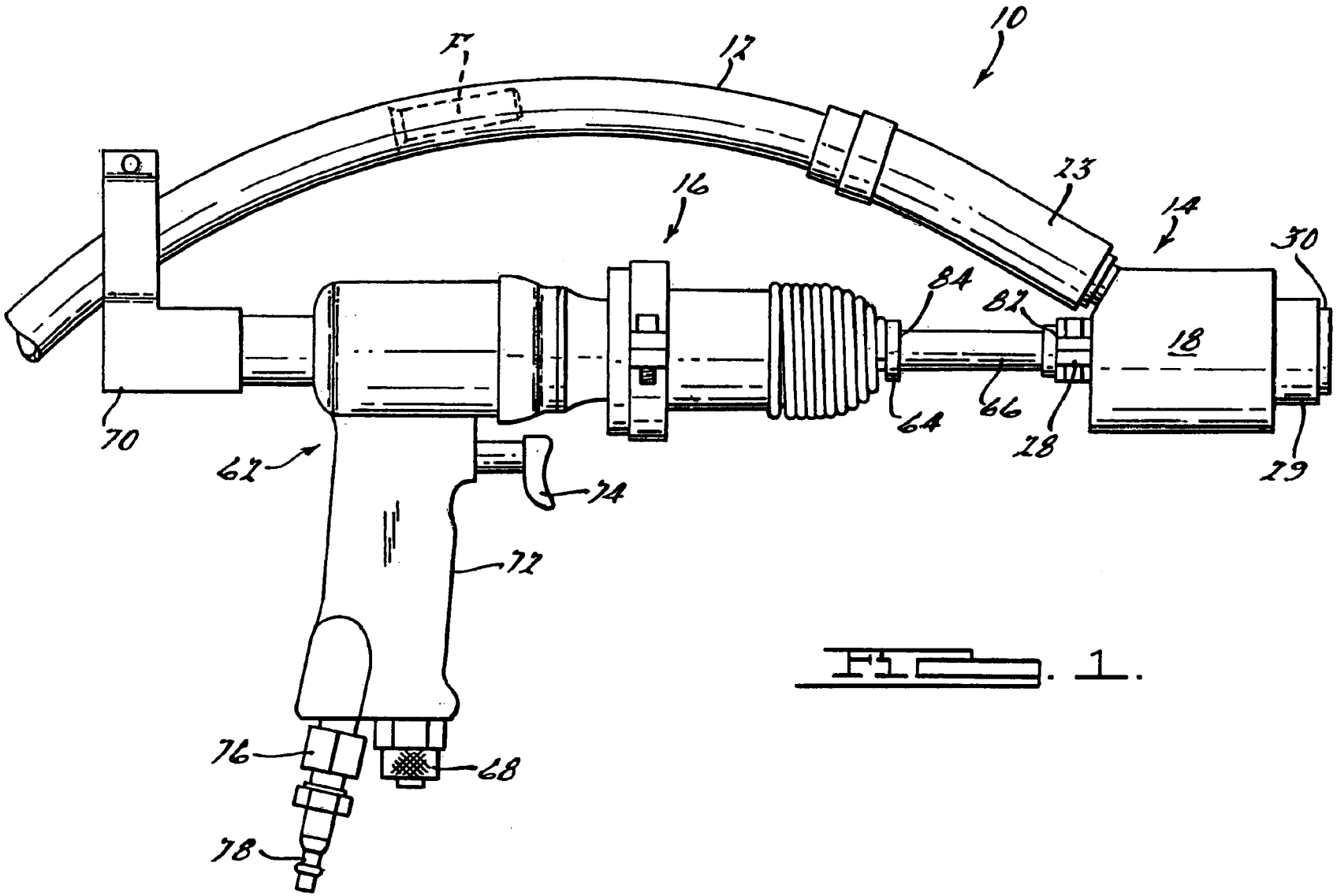
FIG. 1 is a side view of an adaptable fastener installation tool according to the principles of the present invention.
Figure 1:
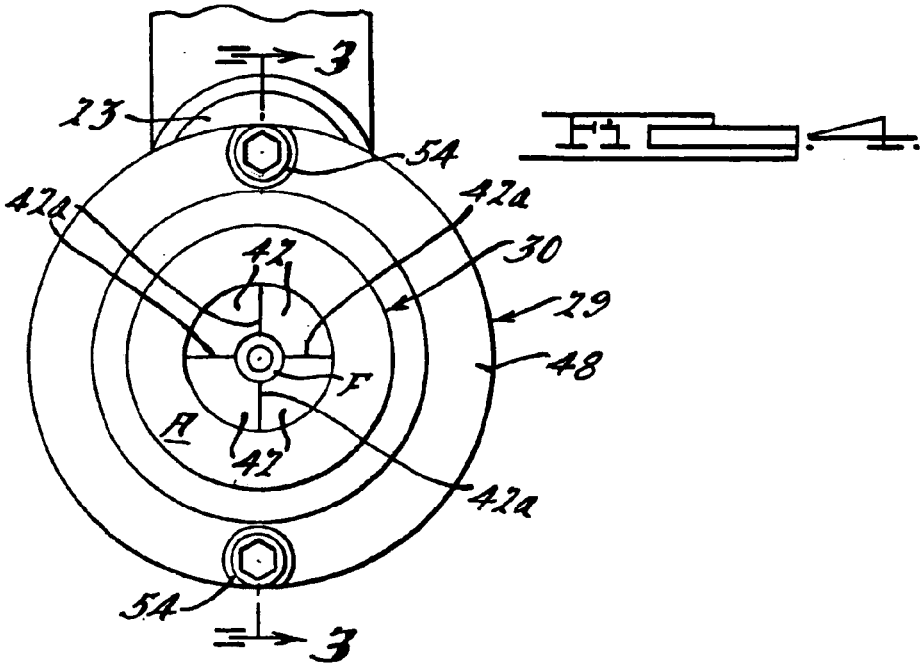

Referring to FIG. 1, an adaptable fastener installation tool 10 in accordance with a preferred embodiment of the present invention is shown. The tool 10 receives a selected fastener F (shown in phantom) via a fastener delivery tube 12. The delivery tube 12 is further described in the co-pending application entitled "Portable Automatic Fastener Delivery System," Ser. No. 09/931,501 filed Aug. 16, 2001, the contents of which are incorporated herein by reference in their entirety. In accordance with the co-pending application, the fasteners are delivered through the delivery tube 12 by an air supply (not shown), but other fastener delivery methods commonly known in the art may be employed while remaining within the scope of the present invention. A fastener orientation system 14 coupled to the delivery tube 12 orientates the fastener for installation by an installation unit 16.

Figure 2:
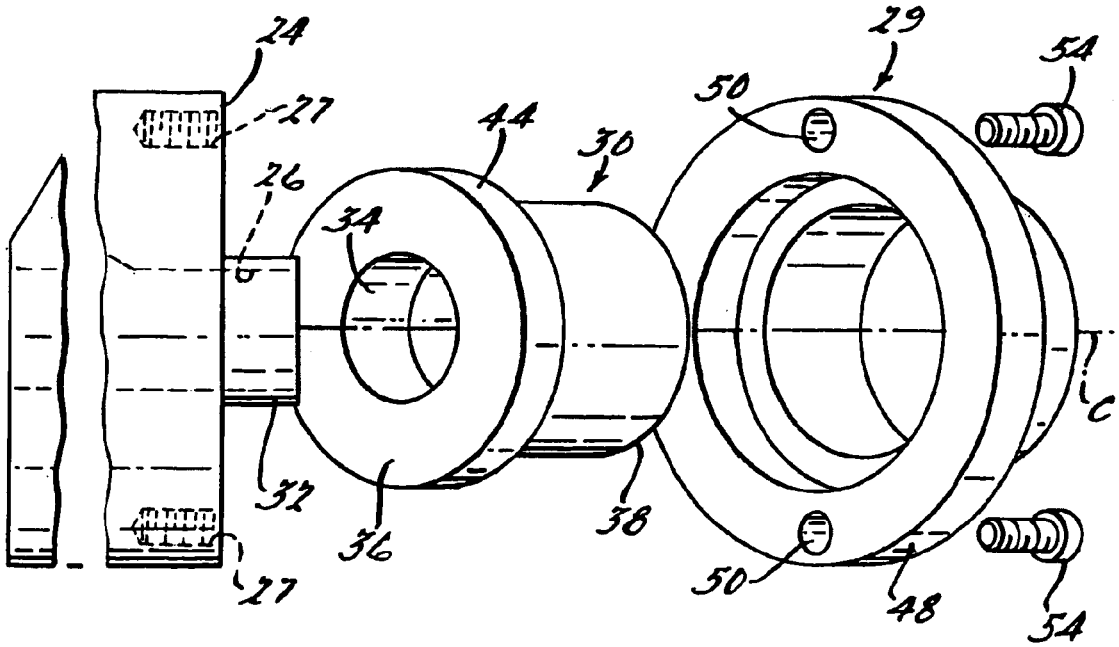
FIG. 2 of the present invention is a partial exploded perspective view of the nozzle of the tool shown in FIG. 1.
Figure 3:
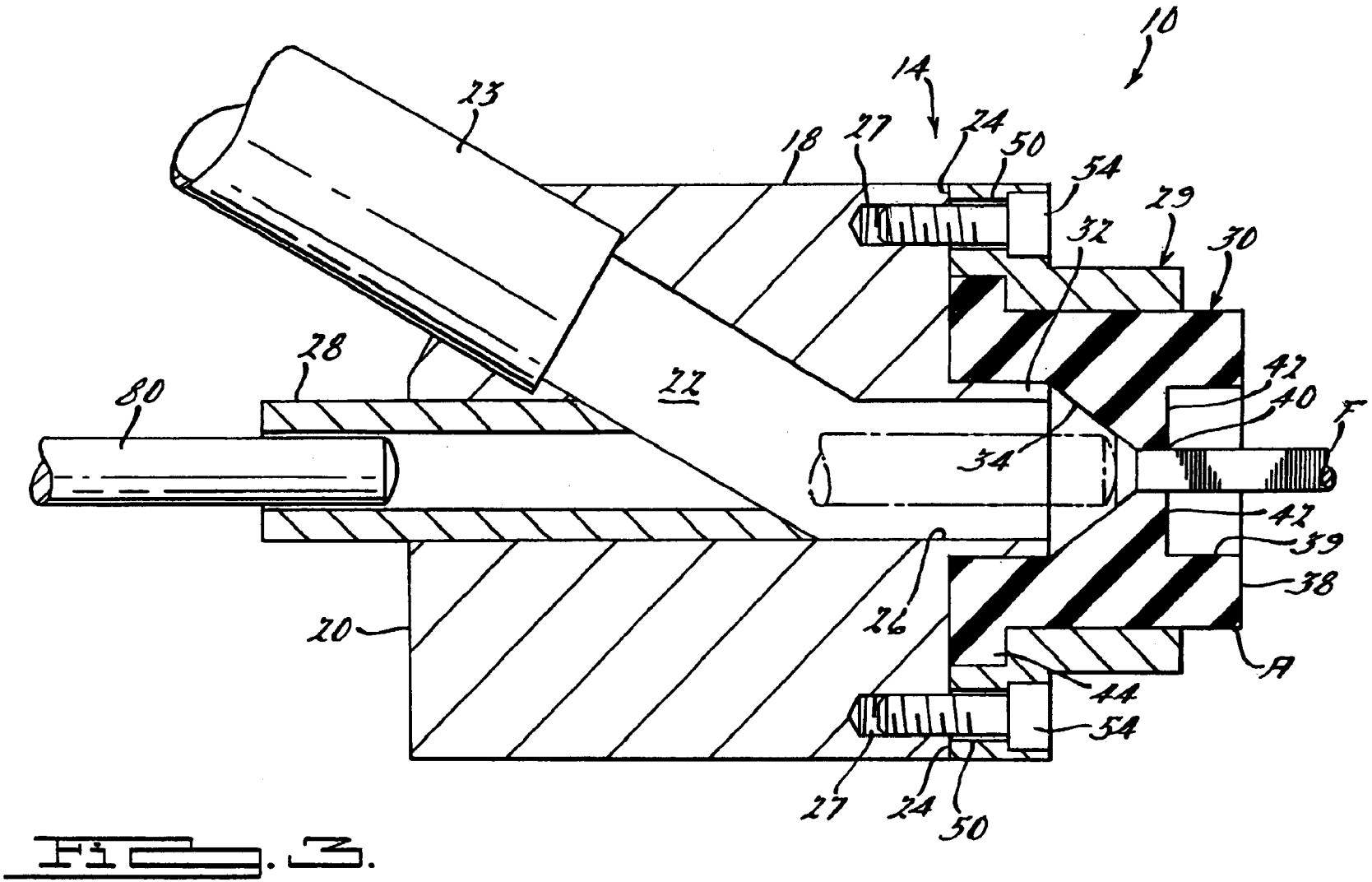
FIG. 3 is a partial cross sectional view of the nozzle along line A—A of the tool shown in FIG. 1.

The fastener orientation system 14 is coupled to the delivery tube 12 via a catcher block 18. Preferably, the catcher block 18 is composed of aluminum, however, any other suitable material could be used. With reference now to FIGS. 2 and 3, the catcher block 18 has a first face 20 with a first bore 22 and a second face 24 with a second bore 26. The second face 24 further includes a pair of openings 27. The first bore 22 of the catcher block 18 couples the fastener orientation system 14 to the delivery tube 12 via a connector 23. In this embodiment, the connector 23 is a hose fitting adhesively coupled to the catcher block 18 at the first bore 22. The first bore 22 is preferably orientated, at an angle of about 20°–45°, and more preferably about 30 degrees, from a centerline C of the catcher block 18 and intersects the second bore 26 as shown in FIG. 3. The second bore 26 extends from the second face 24, and through the catcher block 18, along the centerline C. A sleeve 28 is inserted into the second bore 26 from the first face 20 to the intersection of the first bore 22 and the second bore 26 to provide a locator for the installation unit 16. The second bore 26 is further aligned with a holder or holding jaw 30 adjacent to the second face 24. Thus, as the fastener is propelled through the delivery tube 12, it passes through the first bore 22 and the second bore 26 of the catcher block 18 until resting in the holding jaw 30.

As shown in FIGS. 2, 3 and 4, the holding jaw 30 is aligned with the second bore 26 of the catcher block 18 via a locating flange 32 extending axially from the second face 24 of the catcher block 18. The locating flange 32 mates with a corresponding opening 34 on a first end 36 of the holding jaw 30. The first end 36 also has an annular locating flange 44. As shown in FIG. 3, the opening 34 is conical in shape and serves to direct the incoming fastener into the center of a second end 38 of the holding jaw 30. The second end 38 has an opening 40 surrounded by a plurality of grip fingers 42. The opening 40 is sized preferably about 0.20 in. (0.508 cm) smaller than the diameter of the smallest fastener available for installation by the tool 10 to ensure a firm grasp on the fastener. The grip fingers 42 (FIG. 4) surrounding the opening 40 enable the fastener to pass through the holding jaw 30 during installation without damage to either the fastener or the holding jaw 30. The grip fingers 42 are formed by radial cuts 42*a* or otherwise forming the material surrounding the opening 40 to form the plurality of grip fingers 42 which can deform and move laterally with respect to the holding jaw 30, as best shown in FIG. 4.

With reference now to FIG. 3, the holding jaw 30 is also counterbored up to the second end 38 to form recess 39, to prevent any portion of the holding jaw 30 from being caught between the fastener and the workpiece during installation. Preferably, the holding jaw 30 is composed of room-temperature-vulcanizing (RTV) rubber, such as RTV 664.

A retaining cap 29 fixedly attaches the holding jaw 30 to the catcher block 18. Specifically, the retaining cap 29 has a counterbored annular flange 48 which fits over the annular locating flange 44 of the holding jaw 30 and mates with the second face 24 of the catcher block 18. The annular flange 48 has a pair of openings 50 for the receipt of fasteners 54 therethrough. The openings 50 correspond with the pair of openings 27 located on the second face 26 of the catcher block 18. The retaining cap 29 is preferably made from aluminum and sized such that a portion "A" (FIG. 3) of the second end 38 of the holding jaw 30 extends beyond the retaining cap 29. The portion A of the second end 38 acts as a skid resistant and impact absorbing interface for the workpiece.

Once the fastener is properly positioned by the fastener orientation system 14, it is ready for installation by the installation unit 16. Referring to FIG. 1, the installation unit 16 has a rivet gun 62 coupled to the fastener orientation system 14 via a damping bushing 64 and a telescopic yoke 66. The rivet gun 62 is a standard pneumatic rivet gun having a mechanism 68 for adjusting the impact force. One such rivet gun is available as model no. AVC12A1, manufactured by Igersoll-Rand, however, any other suitable pneumatic rivet gun may be used. The rivet gun 62 features a bracket 70 for supporting the fastener delivery tube 12. The rivet gun 62 also has a handle 72 with a trigger 74 and a valve 76. The valve 76 couples the rivet gun 62 to a pneumatic feed line 78 to provide the operating force. The trigger 74 activates the rivet gun 62 when the fastener is ready to be seated into the workpiece. The rivet gun 62 uses a knock-out punch rivet set 80 as shown in FIG. 3. The knock-out punch rivet set 80 is 0.25 in. (0.64 cm.) in diameter and 3.5 in. (8.89 cm) in length. The end of the knock-out punch rivet set 80 is crowned and polished to prevent damage to the fastener head. The rivet gun 62 is further coupled to the damping bushing 64. The rivet set 80 is inserted into the end of rivet gun 62 just as any other standard rivet set and is retained in position with a standard rivet set safety spring. The damping bushing 64 slips over the end of the knock-out punch rivet set 80. The telescopic yoke 66 clamps to the body of the rivet gun 62 by tightening a clamp screw.

With reference to FIG. 1, the damping bushing 64 serves to limit the travel of the rivet gun 62 as it hammers the fastener into the workpiece. Specifically, the damping bushing 64 enables the fastener to be fully seated in the workpiece without causing damage to the head of the fastener. The length of the damping bushing 64 is designed to leave the fastener head about 0.125 in. (0.32 cm) high when the rivet gun 62 is set to the minimum impact force. The damping bushing 64 is preferably made from fiberglass-reinforced vinyl, however any other suitable material could be employed. The damping bushing 64 is inserted over the knock-out punch rivet set 80.

The telescopic yoke 66 couples the rivet gun 62 to the fastener orientation system 14. The telescopic yoke 66 is a modified "aline-a-drill" yoke which is available from American Aerospace, Inc. in St. Louis, Mo. In particular, a first end 82 of the telescopic yoke 66 clamps to the first face 20 of the catcher block 18 at the sleeve 28 and a second end 84 couples to the body of the rivet gun 62. The telescopic yoke 66 is shown in an extended position in FIG. 1. The rivet gun 62 moves linearly with respect to the catcher block 18 by cycling the telescopic yoke 66. When the telescopic yoke 66 is in a retracted position, the installation unit 16 is ready to install the fastener.

Figure 5:
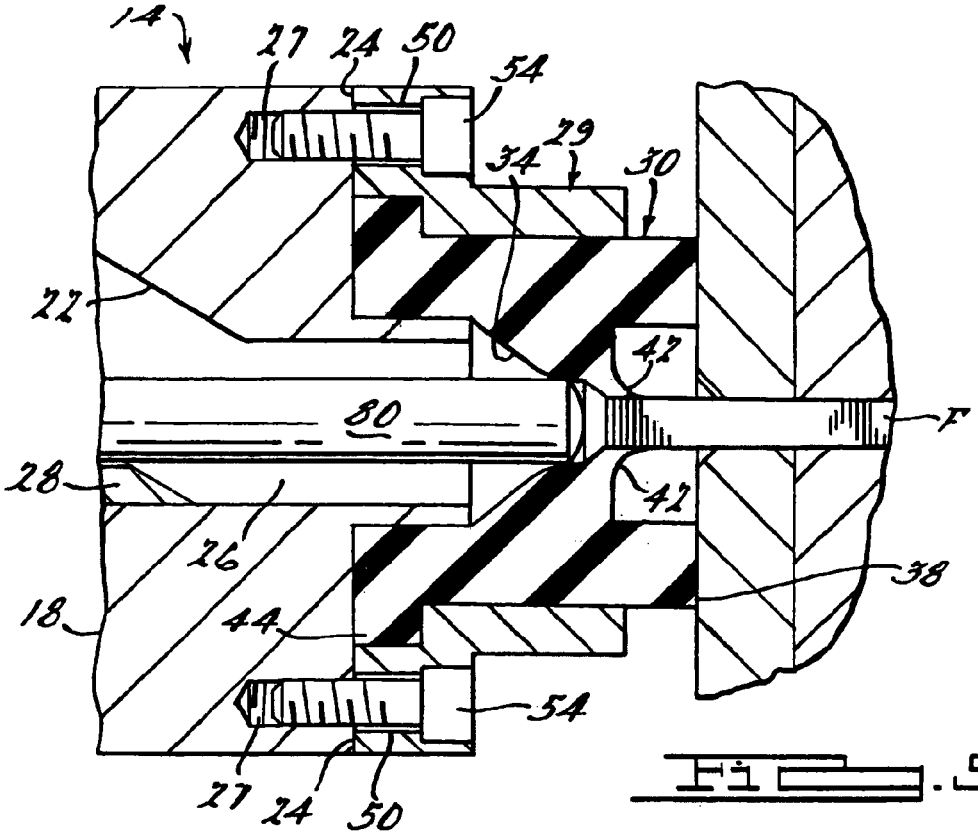
FIG. 5 is a partial cross-sectional view along line A—A in which the rivet gun has been fired to begin installation of the fastener.
Figure 6:
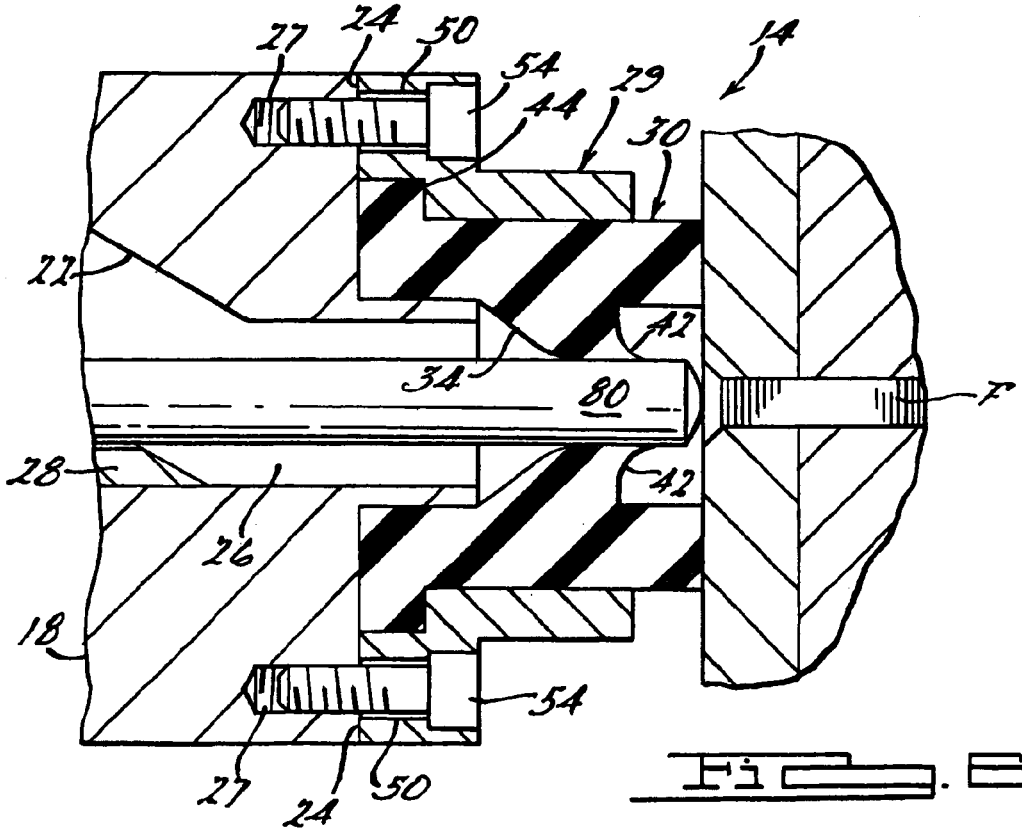
FIG. 6 is a partial cross sectional view along line A—A showing the system after a fastener has been fully installed.

During operation, a blast of pressurized air (typically 25 psi to 30 psi) propels the fastener through the delivery tube 12 and into the first bore 22 of the catcher block 18. The fastener then travels from the first bore 22 into the second bore 26 of the catcher block 18 and into the holding jaw 30. The fastener enters the conical opening 34 of the holding jaw 30 and comes to a rest in the grip fingers 42. Next, an operator slides the rivet gun 62 and knock-out punch rivet set 80 forward to push the fastener further into the holding jaw 30, as shown in FIG. 5. The shank of the fastener F is now exposed through the second end 38 of the holding jaw 30 as shown in FIG. 3. This enables the operator to easily insert the fastener into a hole in the workpiece. In particular, the operator inserts the shank of the fastener into the hole on the workpiece until the second end 38 of the holding jaw 30 rests against the workpiece. Next, the operator pulls the trigger 74 on the rivet gun 62 and the rivet gun 62 is activated. With reference now to FIG. 6, the hammering action of the rivet gun 62 drives the fastener through the grip fingers 42 on the holding jaw 30 and into the interference fit portion of the hole on the workpiece. The impact force of the rivet gun 62 and the length of the damping bushing 64 can be adjusted by the operator to fully seat the fastener in the hole without damaging the fastener head or the adjacent workpiece.

The tool 10 provides a mechanism to install and fully seat interference fasteners in one step, greatly reducing current cycle times. Furthermore, the use of RTV rubber allows the holding jaw 30 to accommodate multiple fastener diameters while keeping the design simple, inexpensive and easy to fabricate. The RTV rubber is also soft enough to prevent any damage to the fastener. In addition, the use of the damping bushing 64 enables the fastener to be fully seated without causing damage to the fastener head.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A system for installing fasteners into a workpiece, comprising:

a fastener delivery apparatus;

a fastener orientation system coupled to the fastener delivery apparatus for receipt of a fastener therein; and an installation unit coupled to the fastener orientation system including a component insertable into said fastener orientation system that is operable to move laterally with respect to the fastener orientation system to provide a force for securing the fastener in the workpiece;

wherein the fastener orientation system includes a holding jaw including a plurality of deformable fingers for temporarily retaining the fastener just prior to said fastener being aligned with an opening in the workpiece;

a catcher block coupled to the holding jaw and the delivery apparatus; and said catcher block includes a first bore offset from and intersecting a second bore, with the first bore coupling the catcher block to the delivery apparatus and the second bore aligned with the holding jaw to provide passage for the fastener therethrough.

2. The system of claim 1 wherein the second bore lies substantially along a centerline of the catcher block and extends therethrough for receipt of a sleeve to couple the catcher block to the installation unit.

3. The system of claim 1 wherein the catcher block further includes a locator flange to align the holding jaw with the second bore and a retaining cap to couple the holding jaw to the catcher block.

4. The system of claim 1 wherein the holding jaw includes a conical opening to channel the fastener into an annular opening in the holding jaw, the annular opening including a centerline substantially coaxial to the centerline of the catcher block.

5. The system of claim 4 wherein the annular opening is substantially surrounded by the plurality of fingers.

6. The system of claim 5 wherein the annular opening is substantially located at an end of a first portion of the holding jaw, with a second portion of the holding jaw counterbored such that the annular opening is visible.

7. The system of claim 1 wherein the installation unit includes a telescopic yoke coupled to the sleeve.

8. The system of claim 7 wherein the installation unit further includes a pneumatic rivet gun coupled to the telescopic yoke for installing the fastener into the workpiece.

9. The system of claim 8 wherein a damping bushing coupled to the rivet gun and the telescopic yoke to limit the travel of the rivet gun during installation.

10. The system of claim 8 wherein the rivet gun includes a knock-out punch rivet set, with the knock-out punch crowned and polished to prevent damage to the fastener.

11. The system of claim 1 wherein the holding jaw is comprised of room-temperature-vulcanizing rubber to prevent damage to the fastener.

12. A system for installing fasteners into a workpiece, comprising:

a fastener delivery tube;

a catcher block coupled to the fastener delivery tube for receipt of a fastener therein;

an installation unit coupled to a first end of the catcher block and having a component insertable into the catcher block to provide a force for securing the fastener in the workpiece;

a holding jaw coupled to a second end of the catcher block, the holding jaw including a plurality of deformable fingers for retaining the fastener; and wherein said catcher block includes a first bore and a second bore, the first bore extending non-parallel to the second bore, with the first bore coupling the catcher block to the delivery tube and the second bore enabling insertion of the component into the catcher block to engage the fastener.

13. The system of claim 12 wherein the second bore lies substantially along a centerline of the catcher block and extends therethrough for receipt of a sleeve to couple the catcher block to the installation unit.

14. The system of claim 13 wherein the catcher block further includes a locator flange to align the holding jaw with the second bore and a retaining cap to couple the holding jaw to the catcher block.

15. The system of claim 13 wherein the holding jaw includes a conical opening to channel the fastener into an annular opening in the holding jaw, the annular opening including a centerline substantially coaxial to the centerline of the catcher block.

16. The system of claim 15 wherein the annular opening is substantially surrounded by the plurality of fingers.

17. The system of claim 15 wherein the annular opening is substantially located at an end of a first portion of the holding jaw, with a second portion of the holding jaw counterbored such that the annular opening is visible.

18. The system of claim 13 wherein the installation unit further comprises:

a telescopic yoke coupled to the sleeve;

a pneumatic rivet gun coupled to the telescopic yoke for installing the fastener into the workpiece; and a damping bushing coupled to the rivet gun to limit the travel of the rivet gun during installation;

wherein the rivet gun includes a knock-out punch rivet set, with the knock-out punch crowned and polished to prevent damage to the fastener and sized to enable the rivet set to translate within the sleeve.

19. The system of claim 12 wherein the holding jaw is comprised of room-temperature-vulcanizing rubber to prevent damage to the fastener.

20. A system for installing fasteners into a workpiece, comprising:

a fastener delivery tube;

a fastener orientation system coupled to the fastener delivery tube for receipt of a fastener therein;

a telescopic yoke coupled to the fastener orientation system;

a pneumatic rivet gun coupled to the telescopic yoke, the pneumatic rivet gun including a rivet set, the rivet set operable to engage the fastener, for installing the fastener into the workpiece; and a damping bushing coupled to the rivet gun to limit the travel of the rivet gun during installation;

the fastener orientation system including a holding jaw including a plurality of fingers for retaining the fastener;

a catcher block including a first bore coupled to the delivery tube;

a second bore having a first end and a second end, the second bore intersecting the first bore, the second end coupling the catcher block to the holding jaw; and a sleeve coupled to the first end of the second bore for coupling the telescopic yoke to the fastener installation system;

wherein the first bore is offset 30 degrees from the second bore.

21. The system of the rivet set comprises a knock-out punch crowned and polished to prevent damage to the fastener.

22. The system of claim 20 wherein the catcher block further includes a locator flange to align the holding jaw with the second bore and a retaining cap to couple the holding jaw to the catcher block.

23. The system of claim 20 wherein the holding jaw includes a conical opening to channel the fastener into an annular opening in the holding jaw, the annular opening including a centerline substantially coaxial to the centerline of the catcher block.

24. The system of claim 23 the annular opening is substantially surrounded by the plurality of fingers.

25. The system of claim 24 wherein the annular opening is substantially located at an end of a first portion of the holding jaw, with a second portion of the holding jaw counterbored such that the annular opening is visible.

26. The system of claim 20 wherein the holding jaw is comprised of room-temperature-vulcanizing rubber to prevent damage to the fastener.

* * * * *